United States Patent [19]

Schaum

[11] 4,342,242

[45] Aug. 3, 1982

[54] HYDRAULICALLY ACTUATED FOOD SLICER

[76] Inventor: Benny R. Schaum, P.O. Box 172, Bixby, Okla. 74008

[21] Appl. No.: 146,770

[22] Filed: May 5, 1980

[51] Int. Cl.[3] ..... B26D 1/03

[52] U.S. Cl. ..... 83/437; 83/407; 83/431; 83/425.3; 83/639; 83/857

[58] Field of Search ..... 83/437, 431, 425.3, 83/404.3, 408, 639, 856–858

[56] References Cited

U.S. PATENT DOCUMENTS

| | | | |
|---|---|---|---|
| 1,771,496 | 7/1930 | Leguillon | 83/437 |
| 2,423,399 | 7/1947 | Myers | 83/437 |
| 2,692,430 | 10/1954 | Kraft et al. | 83/437 |
| 3,187,432 | 6/1965 | Guomo | 83/431 |
| 3,811,348 | 5/1974 | Brown | 83/639 X |
| 4,051,757 | 10/1977 | Reifenhäuser et al. | 83/437 |

*Primary Examiner*—Donald R. Schran
*Attorney, Agent, or Firm*—Head, Johnson & Stevenson

[57] ABSTRACT

A hydraulically actuated food slicer comprising a base plate having a receptacle mounted thereon for receiving the food to be sliced therein and having one open end and one end closed by a cutting grid assembly, a piston member extending through the open end of the receptacle and reciprocally disposed therein for movement alternately toward and away from the cutting grid assembly for urging the food through the grid, a hydraulic cylinder operably connected with the piston for action thereof, a fluid source in communication with the cylinder for supplying fluid power thereto, and a reciprocal foot lever operably connected with the fluid source for selectively applying the fluid to the cylinder during operation of the food slicer.

4 Claims, 9 Drawing Figures

HYDRAULICALLY ACTUATED FOOD SLICER

BACKGROUND OF THE INVENTION

1. Field of the Invention

This invention relates to improvements in food handling equipment and more particularly, but not by way of limitation, to a hydraulically actuated food slicer.

2. Description of the Prior Art

In many food establishments, great quantities of food must be sliced, diced, or otherwise severed into relatively small pieces prior to preparation thereof for eating. At the present time, many of these food items are sliced or cut by hand or by devices which are manually actuated through the main strength of the person handling the food. Other foods are processed by electrical applicances, but with the present day energy crisis the cost of operation of these electrical appliances is becoming a detriment to the use thereof in the food serving and preparation industry. In the case of manual cutting of the food products, the time of preparation becomes great and thus costly. In addition, the present day trend toward fast food establishments has placed increasing emphasis on reducing both the time and cost of handling of the food products prior to the consumption thereof.

SUMMARY OF THE INVENTION

The present invention contemplates a novel food handling apparatus particularly designed and constructed for overcoming the foregoing disadvantages. The novel apparatus comprises a base plate adapted to be disposed on a substantial supporting surface, such as a table top or the like, and is provided with a food receiving receptacle having one end closed by a cutting grid assembly and the opposite end open for receiving a piston member therethrough. The piston member is operably connected with a suitable hydraulic cylinder which moves the piston alternately toward and away from the cutting grid assembly for forcing any food in the receptacle through the grid for cutting of the food in the desired pattern. A fluid source is operably connected with the cylinder for actuation thereof, and a foot lever assembly is interposed in the fluid source for selectively directing the fluid to the cylinder during operation of the apparatus. The ratio of output at the cutting grid to the input at the foot lever assembly is such that relatively little force is required at the foot lever for quickly and efficiently forcing the food product through the cutting grid. In this manner relatively large quantities of food may be sliced, diced, or otherwise cut into desired configurations as required for the ultimate preparation and consumption of the food product. The food may thus be efficiently and economically prepared in a manner which reduces both time and energy. The novel food handling apparatus is simple and efficient in operation and economical and durable in construction.

DESCRIPTION OF THE PREFERRED EMBODIMENT

Figures 1, 2:
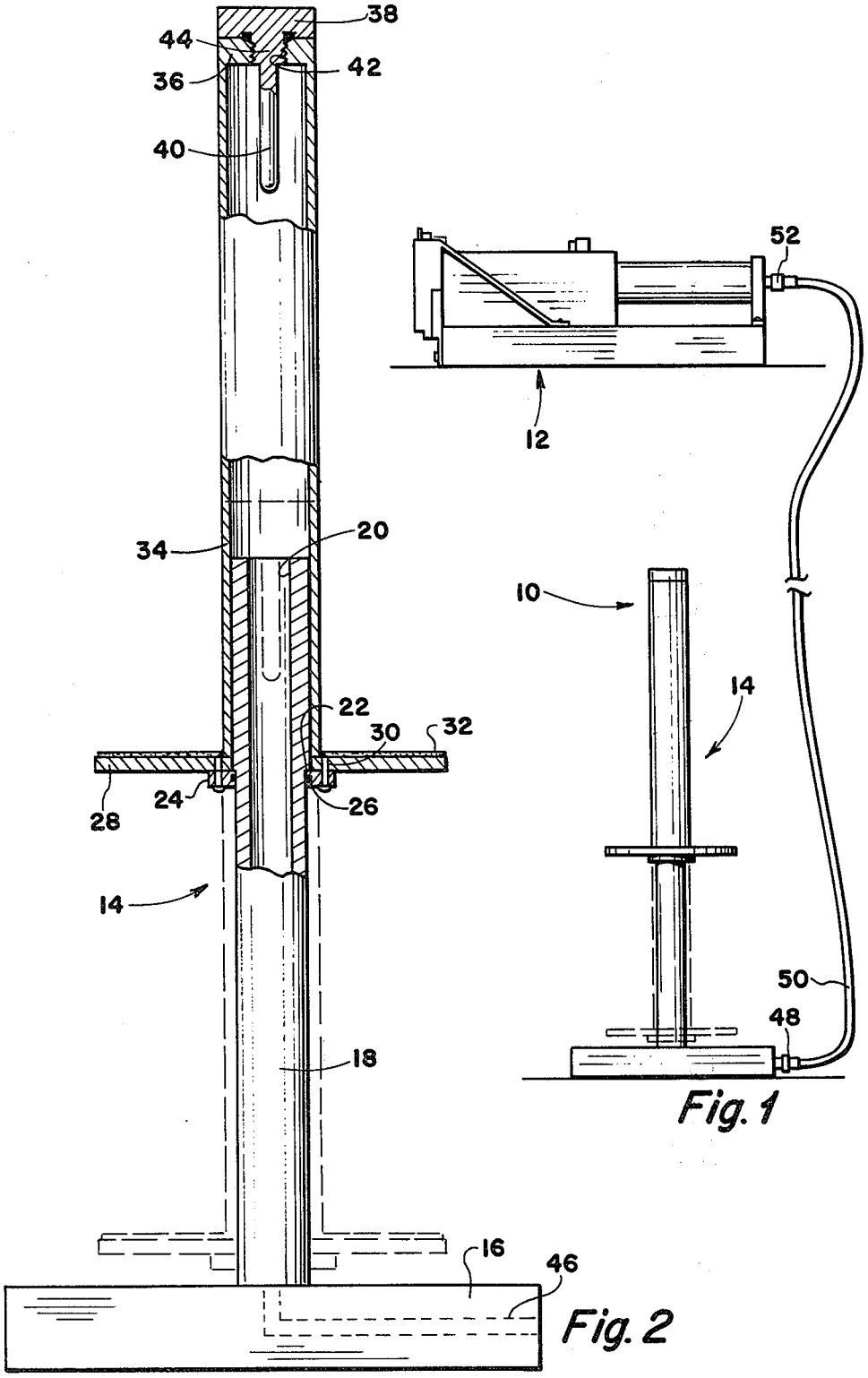
FIG. 1 is a side elevational view of a food handling apparatus embodying the invention.
FIG. 2 is a front elevational view of a foot lever assembly utilized in a food handling apparatus embodying the invention, with portions shown in section for purposes of illustration, and showing one position thereof in solid lines and another position thereof in broken lines.

Referring to the drawings in detail, reference character 10 generally indicates a food handling apparatus comprising a food cutting or slicing assembly 12 operably connected with a foot lever assembly 14, as particularly shown in FIG. 1. The foot lever assembly 14 comprises a suitable support base member 16 having an upstanding tube member 18 mounted therein in any suitable manner (not shown). The lower end of the tube 18, as shown in FIG. 2, is closed by the plate or base member 16 and the upper end thereof is open as shown at 20. An outwardly extending circumferential shoulder 22 is provided on the outer periphery of the tube 18, and an annular ring member 24 is slidably disposed around the outer periphery of the tube 18 and is positioned between the shoulder 22 and the base 16 whereby the length of travel of the ring 24 will be limited in one direction by engagement with the shoulder 22 as shown in solid lines in FIG. 2. It is preferable to provide a suitable sealing member, such as an O-ring 26 between the inner periphery of the ring 24 and the outer periphery of the tube 18 for precluding leakage of fluid therebetween, as will be hereinafter set forth. An annular plate member 28 is disposed around the outer periphery of the tube 18 above the ring 24 and is rigidly secured to the ring 24 in any suitable manner, such as by a plurality of rivets 30, or the like. It is preferable to provide an annular pad or friction means 32 on the upper surface of the plate 28 to facilitate use of the plate 28 as a foot lever during operation of the apparatus 10, as will be hereinafter set forth.

A second tubular member 34 is telescopically arranged over the outer periphery of the tube 18, and the lower end of the tube 34 is open for receiving the tube 18 therein. In addition, the open lower end of the tube 34 is soldered or otherwise rigidly secured to the inner periphery of the plate 28 for movement simultaneously therebetween. The outer end of the tube 34 is closed by a wall member 36 having an end cap 38 threadedly secured thereto. The end cap 38 is provided with an axially extending centrally disposed probe member 40 which extends through a threaded central bore 42 provided in the wall 36 and longitudinally through a portion of the tube 34. The probe 40 is provided with an externally threaded portion 44 which cooperates with the threads 42 for removably securing the end cap 38 in place on the end wall 36, thus providing for selective access to the interior of the tubes 34 and 18. A substantially L-Shaped passageway 46 is provided in the base member 16 and has one end in communication with the interior of the tube 18 and the opposite end open to the exterior of the base 16 for receiving a suitable fitting 48 therein. A hose or conduit 50 is secured to the fitting 48 in open communication with the passageway 46 and extends to a second suitable fitting 52 which connects the foot lever assembly 14 with the food slicing assembly 12.

The food slicing assembly 12 comprises a suitable support base 54 having a receptacle 56 mounted thereon in any suitable manner for receiving the food to be processed therein. The receptacle 56 as shown herein preferably comprises a pair of upstanding mutually parallel side panels 58 and 60 spaced apart by a bottom plate 62 which rests on and is preferably secured to the upper surface of the support base 54. A pair of substantially identical oppositely disposed angularly orientated brace members 64 and 66 are bolted or otherwise secured to the plate 62 outboard of the side panels 58 and 60, respectively. The outer end of each brace 64 and 66 terminates in an upstanding guide or track member 68 and 70, respectively, which are provided with inwardly directed elongated slots or recesses 72 and 74, respectively. The slots 72 and 74 are disposed in substantially alignment for slidably receiving the opposite side edges of a cutting grid assembly 76 therein. The cutting grid assembly 76 closes the outer end of the receptacle 56 in a manner and for a purpose as will be hereinafter set forth.

The inner end of the receptacle 56 is open for receiving a piston or plunger member 78 therethrough. The piston 78 is preferably comprised of a substantially slab-like body 80 having one face thereof provided with a plurality of spaced axially extending fingers 82 directed toward the cutting grid assembly 76, as particularly shown in FIGS. 3 and 4. A substantially inverted U-shaped recess 84 is provided in the body 80 and has the lower end thereof open as viewed in the drawings. The recess 84 is also open to the face of the body 80 oppositely disposed from the fingers 82, and an internal shoulder 86 surrounds the periphery of the recess 84 for receiving a head member 88 therein. The head member 88 is provided on the outer end of a piston rod member 90 which is slidably disposed within a bearing sleeve 92 contained within a suitable cylinder housing 94. The cylinder housing 94 is mounted on the support base 54 in any suitable or well known manner, and is provided with a threaded port 96 at the outer end thereof for receiving a coupling member 98 therein which secures the fitting 52 to the housing 94 in such a manner that communication is established between the interior of the tubes 18 and 34 and a central passageway 100 extending longitudinally through the piston rod 90.

A screw 102, or the like, is threadedly secured in a centrally disposed threaded bore 104 provided in the head member 88 and a loop or eye member 106 is suitably secured to the inner end of the screw 102. A similar loop or eye member 108 is secured to the inner end of the coupling member 96, and a suitably helical spring 110 has the opposite ends thereof anchored at the eyes 106 and 108 for constantly urging the head member 88 in a direction toward the coupling member 96 for providing a normally retracted position for the tube 92 within the cylinder housing 94, and as particularly shown in FIG. 4. The bore 100, tubing or conduit 50, passageway 46 and tubes 18 and 34 are filled with a suitable hydraulic fluid. As a practical matter it has been found that any standard or widely used cooking oil produces good results in the operation of the apparatus 10, and in the event of spillage or leakage of the fluid, the cooking oils are usually more readily responsive to a cleaning operation than the fluids normally utilized in industrial applications.

Figure 3:
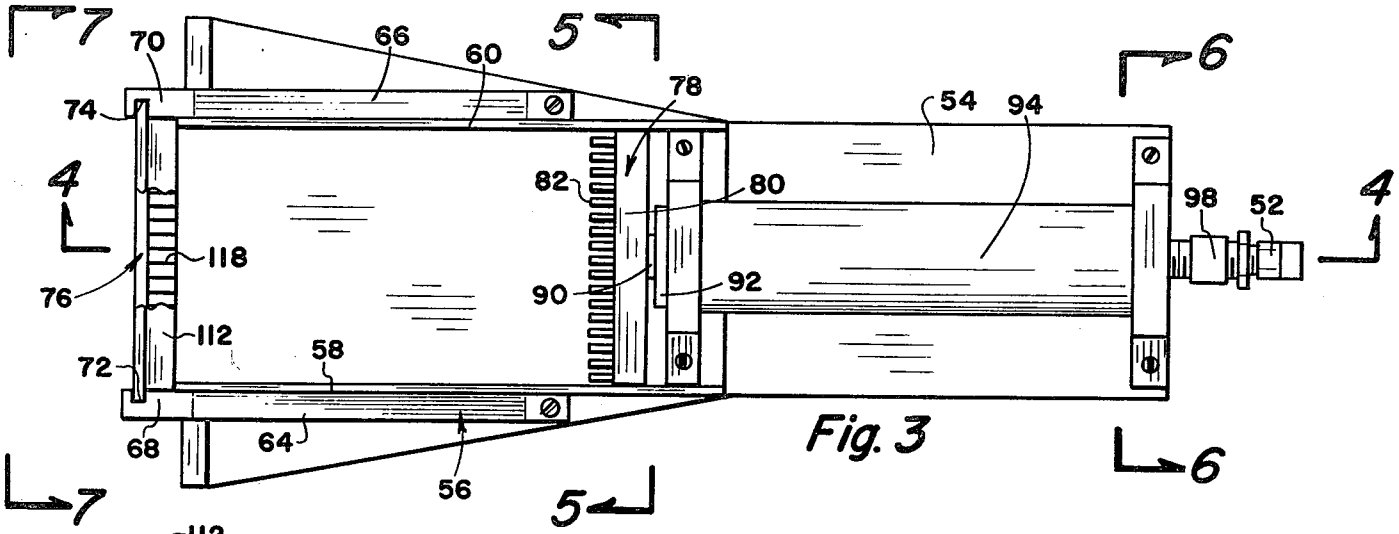
FIG. 3 is a top view of a food receptacle portion of a food handling apparatus embodying the invention.
Figure 4:
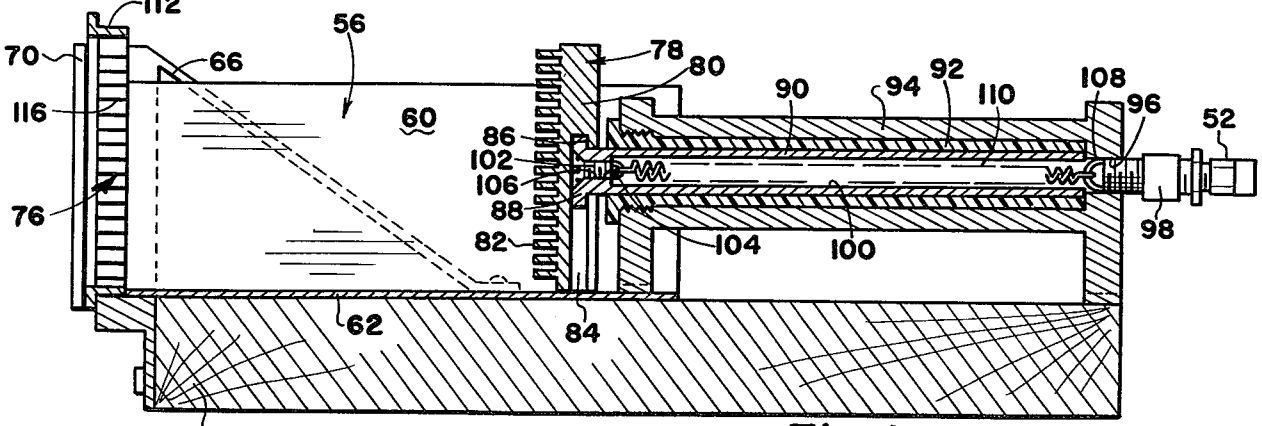
FIG. 4 is a view taken on line 4—4 of FIG. 3.
Figure 5:
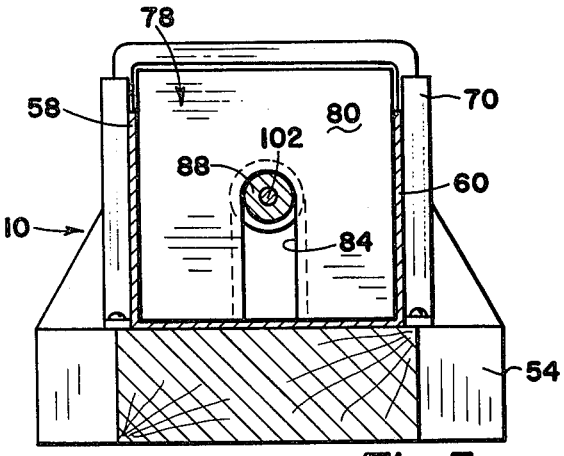
FIG. 5 is a view taken on line 5—5 of FIG. 3.
Figure 6:
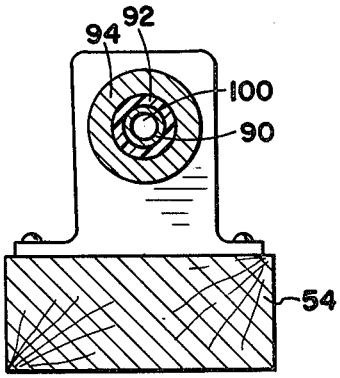
FIG. 6 is a view taken on line 6—6 of FIG. 3.
Figure 7:
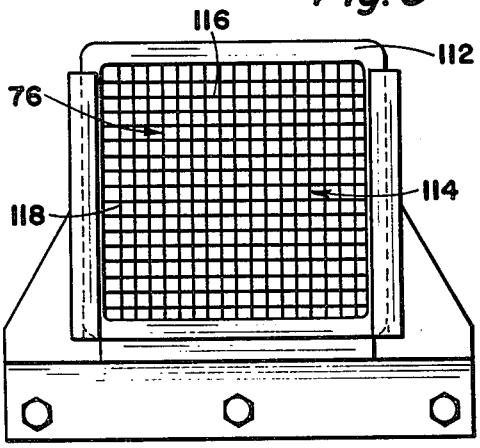
FIG. 7 is a view taken on line 7—7 of FIG. 3.
Figure 8:
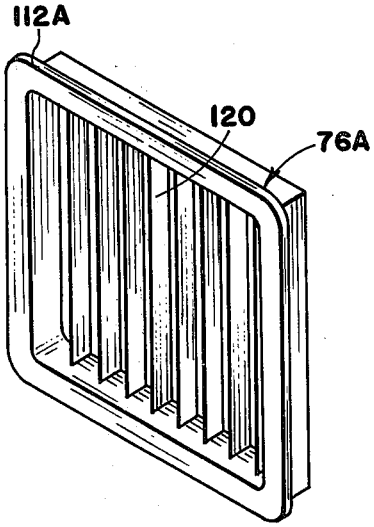
FIG. 8 is a perspective view of a cutting grid assembly as utilized in a food handling apparatus embodying the invention.

The cutting grid assembly 76 as shown in FIGS. 3, 4 and 7 comprises an outer frame 112, preferably of a substantially square or rectangular configuration, with the oppositely disposed side edges thereof being adapted for sliding engagement in the recesses 72 and 74 as hereinbefore set forth. The central portion 114 of the assembly 76 comprises a plurality of spaced mutually parallel cutting blades 116, each having the opposite ends thereof securely anchored at the inner periphery of the opposite side edges of the frame 112. The cutting elements 116 are intersected by a plurality of spaced mutually parallel cutting blades 118, each having the opposite ends thereof securely anchored at the upper and lower edges of the frame 112 as viewed in the drawings. The cutting elements 116 and 118 cooperate to form a grid pattern particularly suitable for severing of food products (not shown) into elongated strips of substantially square cross-sectional configuration, or dicing of the product. FIG. 8 illustrates a modified cutting grid assembly 76A which comprises an outer frame 112A generally similar to the frame 112 and a plurality of spaced mutually parallel cutting elements or blades 120 disposed in the open central portion of the frame 112A. The opposite ends of each blade 120 are securely anchored to the respective side edges of the frame 112A in any suitable manner (not shown). The cutting blades 120 cooperate for severing a food product into relatively thin strips of substantially rectangular cross-sectional configuration, such as often desirable in slicing of a potato (not shown), or the like.

Figure 9:
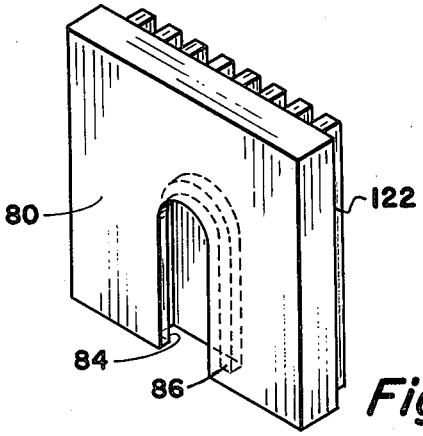
FIG. 9 is a perspective view of a piston member as utilized in a food handling apparatus embodying the invention

The plunger body 80 as shown in FIGS. 3 and 4 is provided with the outwardly extending fingers 82 as hereinbefore set forth. The fingers 82 are particularly spaced and arranged for insertion between the crossing cutting elements or blades 116 and 118 during the cutting or slicing of a food products, as will be hereinafter set forth. Of course, it will be readily apparent that the body 80 may be provided with a plurality of axially outwardly extending spaced, mutually parallel flanges 122 (FIG. 9) in lieu of the fingers 82 for use in combination with the cutting grid assembly 76A. In addition, it will be apparent that the cutting grid may be of substantially any desired combination of cutting elements or blades and the plate 80 may be provided with complimentary axially extending fingers or flanges, and there is no intention of limiting the apparatus to the particularly cutting configurations depicted herein.

In use, the foot lever 28 is normally in the raised or elevated position thereof as shown in solid lines in FIG. 2. When it is desirable to sever a food product (not shown), the food product may be placed in the receptacle 56, through the opening between the side plates or panels 58 and 60, and positioned on the bottom plate 62 between the plunger 78 and the cutting assembly 76. The foot lever 28 may be depressed by stepping thereon with the foot or the person using the device whereupon the tube 34 will be moved downwardly over the outer periphery of the tube 18 to the position shown in broken lines in FIG. 2. (Of course, it will be apparent that the lever or plate 28 may be moved downwardly by the hand of the user rather than the foot, if desired.) This downward movement of the tube 34 over the tube 18 forces the fluid in the tubes to be moved outwardly through the passageway 46 and conduit 50 and into the passageway 100. As soon as the force of the fluid in the passageway 100 becomes greater than the force of the spring 110, the head member 88 will be more in a left hand direction as viewed in FIGS. 3 and 4, thus moving the plunger assembly 78 in a direction toward the cutting grid assembly 76. The food product disposed between the grid assembly and the plunger will be forced in a direction toward and through the grid assembly, whereupon the food product will be cut as required and in accordance with the cutting blades or elements of the particular cutting grid in use.

When the food product has been moved through the cutting grid assembly 76, and the plunger plate 80 will ultimately be brought into engagement with the frame 112, which will limit any further movement of the plunger and head 88. In this position the fingers 82 will be inserted between the cutting elements 116 and 118 for forcing any of the food particles which may remain therebetween out of the grid.

When the food product has been properly processed, the downward pressure on the plate 28 may be released or relieved, whereupon the spring 110 will urge the head member 88 in a direction toward the coupling 96 for returning the plunger assembly 78 to its normal position in spaced relation with respect to the cutting grid assembly, whereupon the entire operation may be repeated with the next succeeding food product to be processed.

From the foregoing it will be apparent that the present invention provides a novel hydraulically actuated food handling apparatus which quickly and efficiently severs the food product into the desired configuration prior to the end preparation of the food product for consumption. The device comprises a foot lever which may be readily depressed for moving a plunger member against the food product for forcing the food product through a cutting grid for slicing, dicing, or the like of the food. The pressure on the foot lever may be released subsequent to the processing of the food product whereupon the apparatus is automatically restored to the normal position thereof for receiving the next food product to be processed. The food may be efficiently and economically processed with rapidity, thus facilitating the handling of great quantities of food.

Whereas the present invention has been described in particular relation to the drawings attached hereto, it should be understood that other and further modifications, apart from those shown or suggested herein, may be made within the spirit and scope of this invention.

What is claimed is:

1. A food handling apparatus comprising food receiving receptacle means, cutting grid means disposed at one end of the food receptacle means, horizontally reciprocal piston means disposed in said food receptacle means and movable in alternate directions toward and away from the cutting grid means, one direction of movement of the piston means operable for forcing the food through the cutting grid means for discharge from the receptacle means and the opposite direction of movement of the piston means operable for restoring the receptacle means to a food receiving position, foot lever means, hydraulic means operably connected between the foot lever means and the piston means for providing said movement for the piston means, wherein the hydraulic means comprises a cylinder housing, a horizontally slidable piston rod means disposed within the housing and having a longitudinally extending central passageway therein for receiving a hydraulic fluid, head means carried by the piston rod means and engagable with the piston means, spring means disposed in the passageway means and operably connected with the head means for constantly urging the piston rod means toward the contracted position thereof within the cylinder housing and conduit means connected between the passageway and the foot lever means for communicating the hydraulic fluid therebetween whereby actuation of the foot lever creates a pressure differentials in the passageway surrounding the spring means for providing said movement for said piston means, the foot lever means comprising telescopically arranged fluid filled tubular members in communication with the conduit means, and outwardly extending foot lever means secured to one of said telescopic tubular members for moving thereof with respect to the other telescopic tubular member for creating said pressure differentials in the passageway, and the piston means comprising a slab-like body member movable in alternate directions toward and away from the cutting grid means, said slab-like body member being engagable with the food for discharging the food from the receptacle upon one direction of movement of the piston means, and axially arranged protrusion members extending from one face of the body in a direction toward the cutting grid means for intermeshing therewith in one relative position therebetween.

2. A food handling apparatus as set forth in claim 1 wherein the cutting grid means comprises an outer frame means removably secured on said food receptacle means, and cutting elements secured in the central portion of the frame means and of a configuration complementary to the protrusion members of the body for intermeshing therewith.

3. A food handling apparatus as set forth in claim 2 wherein the protrusions on the body comprises a plurality of spaced mutually parallel flanges, and the cutting elements in the frame means comprises a plurality of spaced mutually parallel cutting blades arranged for receiving the flanges therebetween.

4. A food handling apparatus as set forth in claim 2 wherein the protrusions on the body comprise a plurality of spaced finger members, and the cutting elements in the frame means comprises a plurality of spaced mutually parallel cutting blades arranged cooperatively with a plurality of spaced cutting blades perpendicular with respect thereto defining a grid pattern for receiving the fingers therethrough.

* * * * *